US009744770B2

(12) United States Patent
Lee et al.

(10) Patent No.: US 9,744,770 B2
(45) Date of Patent: Aug. 29, 2017

(54) CLEANING PADS

(71) Applicant: HEWLETT-PACKARD DEVELOPMENT COMPANY, L.P., Houston, TX (US)

(72) Inventors: Eik-Shern Lee, Singapore (SG); Yuexiang Huang, Singapore (SG); Deyang Wang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/021,483

(22) PCT Filed: Sep. 17, 2013

(86) PCT No.: PCT/US2013/060206

§ 371 (c)(1),
(2) Date: Mar. 11, 2016

(87) PCT Pub. No.: WO2015/041637

PCT Pub. Date: Mar. 26, 2015

(65) Prior Publication Data

US 2016/0221344 A1 Aug. 4, 2016

(51) Int. Cl.

| | |
|---|---|
| ***B41J 29/13*** | (2006.01) |
| ***B41J 2/165*** | (2006.01) |
| ***B41J 29/17*** | (2006.01) |

(52) U.S. Cl.
CPC ..... *B41J 2/16535* (2013.01); *B41J 29/13* (2013.01); *B41J 29/17* (2013.01)

(58) Field of Classification Search
CPC ..... B41J 2/165; B41J 2/16535; B41J 29/17; B41J 2002/1655; B41J 2002/16582; B41J 2202/03
See application file for complete search history.

(56) References Cited

U.S. PATENT DOCUMENTS

| | | | | |
|---|---|---|---|---|
| 5,594,485 | A | 1/1997 | Koike et al. | |
| 6,264,303 | B1 | 7/2001 | Watanabe | |
| 6,375,302 | B1 | 4/2002 | Medin | |
| 6,402,291 | B1 | 6/2002 | Millman et al. | |
| 6,575,553 | B1 | 6/2003 | Williams et al. | |
| 6,746,994 | B2 | 6/2004 | Harper | |
| 6,769,756 | B2 * | 8/2004 | Su | B41J 2/0456 347/19 |

(Continued)

FOREIGN PATENT DOCUMENTS

| | | |
|---|---|---|
| CN | 101062626 | 10/2007 |
| JP | H09189574 | 7/1997 |
| JP | 2001-179961 A | 7/2001 |

(Continued)

OTHER PUBLICATIONS

Feedroller.com, "How to Clean Liquid Ink Printers Inducting Deskjet Inkjet Photo Printers," Copyright 2013 Feedroller, 14 p. http://www.feedroller.com/Store/clean_in.

(Continued)

*Primary Examiner* — Lamson Nguyen
(74) *Attorney, Agent, or Firm* — Dicke, Billig & Cjaza, PLLC

(57) ABSTRACT

A cleaning pad for wiping an encoder strip in a printer has a body of absorbent material. The cleaning pad includes a hygroscopic lubricating liquid.

20 Claims, 2 Drawing Sheets

(56) References Cited

U.S. PATENT DOCUMENTS

| | | | |
|---|---|---|---|
| 2009/0315942 | A1 | 12/2009 | Parazak et al. |
| 2010/0231640 | A1 | 9/2010 | Tsuzuki |

FOREIGN PATENT DOCUMENTS

| | | | |
|---|---|---|---|
| JP | 2004160871 | | 6/2004 |
| JP | 2009-208457 | A | 9/2009 |

OTHER PUBLICATIONS

International Searching Authority—KR. International Search Report. Date of Mailing Jun. 3, 2014. Application No. PCT/US2013/060206. Filing date Sep. 17, 2013.
Chinese Office Action for CN Patent Appln No. 201380079652.2, dated Nov. 11, 2016 (8 Pages).

* cited by examiner

CLEANING PADS

BACKGROUND

Printers may have a moving printhead that is driven by a belt and a control system. To accurately determine the location of the printhead across the width of a print zone, an encoder strip is located within the printer. An optical position sensor on the printhead reads the encoder strip as the printhead moves across the print zone and relays position information to a controller. The controller uses the position information, and other information, to determine when to fire ink from the printhead onto the substrate on which printing is to occur.

Over the lifetime of a printer, an encoder strip may become contaminated with aerosol ink artefacts and ink stains such that it is read less reliably by the position sensor and positional accuracy of elements of the printed image may be affected.

BRIEF DESCRIPTION OF THE DRAWINGS

By way of non-limiting examples, cleaning pads and printhead assemblies according to the present disclosure will be described with reference to the following drawings, in which.

DETAILED DESCRIPTION

A cleaning pad described herein provides a means of cleaning aerosol or ink stain contamination from a print encoder strip. Aerosol contamination of encoder strips can be in the nature of dry particulate material, created as the ink solvent evaporates from the very small aerosol particles before they settle on the encoder strip. However the contamination may not always be dry, possibly due to humidity or other environmental factors. As an example, a cleaning pad which is infused with a hygroscopic lubricant may provide for an inexpensive solution by providing a solvent. For example, the solvent may loosen the contaminating material from the surface of the encoder strip and then transfusion of the contaminant from the surface of the cleaning pad to its interior may be facilitated to minimise redistribution of the contaminant by the cleaning pad. The result may reduce the probability of carriage precision positioning error and increase reliability over the useful life of the printer, and particularly as the printer ages, without employing complex and expensive design changes of the printhead assembly.

Figure 1:
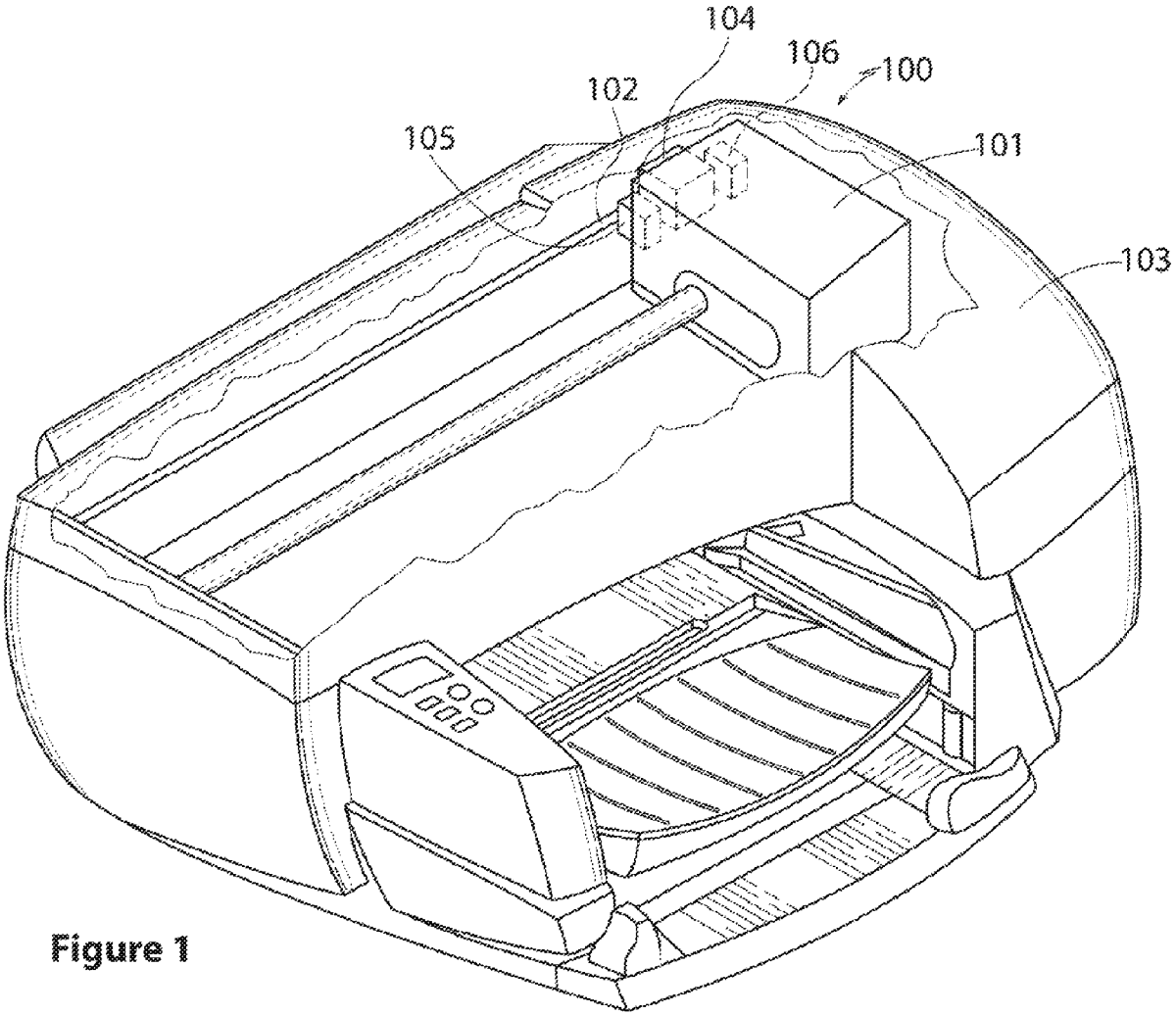
FIG. 1 is a perspective view of a printer with cleaning pads fitted.

FIG. 1 illustrates an example of a printer 100 comprising printhead carriage 101 and an adjacent portion of an encoder strip 102 viewed through a cut-away portion of a housing 103. A position sensor 104 is mounted on the printhead carriage 101 in close proximity to the encoder strip 102 and a cleaning pad 105 is also located on the printhead carriage 101 and touching the encoder strip 102. A second cleaning pad 106 may also be provided, on the opposite side of the sensor 103 with respect to the first cleaning pad 105.

Figure 2:
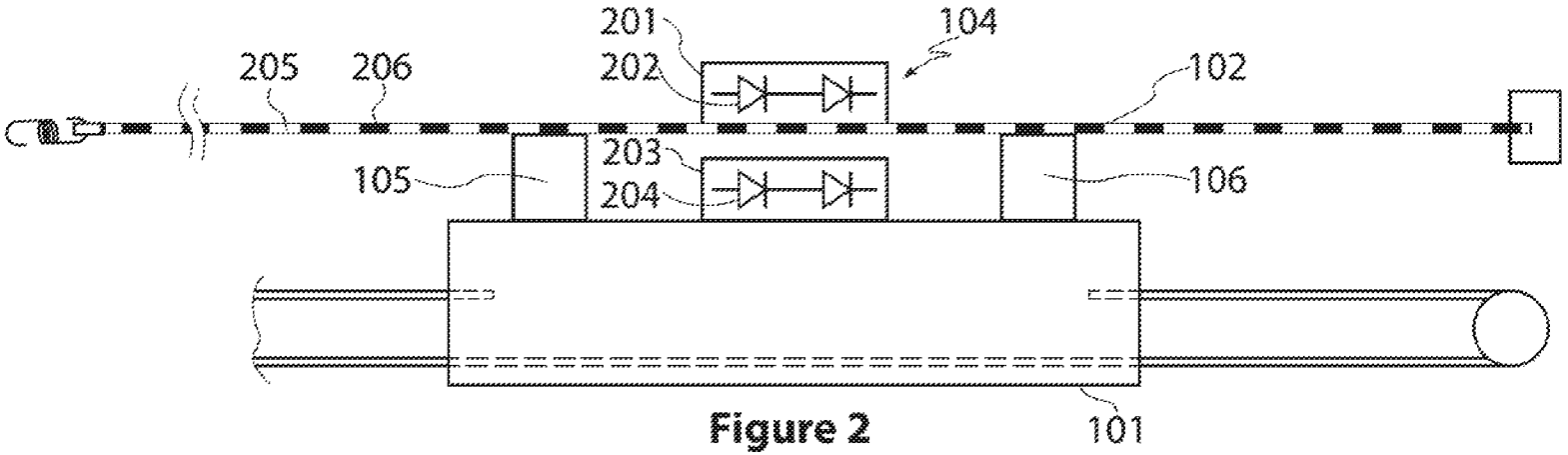
FIG. 2 diagrammatically illustrates an example of a printhead assembly for the printer of FIG. 1 with cleaning pads fitted.
Figure 4:
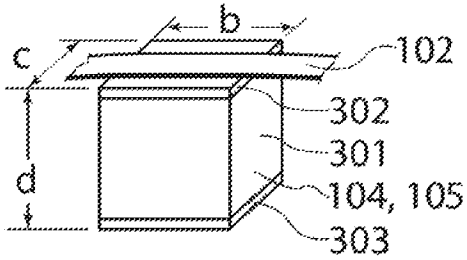
FIG. 4 diagrammatically illustrates the cleaning pad of FIG. 3 when compressed.

FIG. 2 diagrammatically illustrates (not to scale) the printhead carriage 101 and encoder strip 102 of the printer 100 of FIG. 1. The cleaning pad 105 is located to lightly press against the encoder strip such that, as the printhead carriage 101 travels across the printer 100, the cleaning pad 105 wipes the encoder strip 102. The second cleaning pad 106, if provided, is also located to lightly press against the encoder strip such that as the printhead carriage 101 travels across the printer 100, the cleaning pad 106 wipes the encoder strip 102. The cleaning pad 106 may be generally similar or identical to the cleaning pad 105 in construction and dimensions. The cleaning pads 105 & 106 may for example be bonded to a surface of the printhead carriage 101 with a double sided tape or an adhesive.

The sensor 104 may typically comprise a transmitter section 201 having a plurality of LED emitters 202 and a receiver section 203 having a corresponding plurality of light receivers (detectors) 204 (e.g. photodiodes). The number of LED-photodiode pairs 202, 204 may vary. The light receivers 204 detect light transmitted by the LEDs 202 when the respective LED-photodiode pair 202, 204 is positioned over a transparent section 205 of the encoder strip 102. Conversely, the light receivers 204 are blocked from receiving light transmitted by the LEDs 202 when the respective LED—photodiode pair 202, 204 is positioned over an opaque section 206 of the encoder strip 102. Multiple LED-photodiode pairs 202, 204 may be used to provide redundancy allowing a degree of error correction.

In one example the encoder strip 102 may be restrained by pressing against a surface of the transmitter section 201 of the position detector. In another example, it would also be possible to reverse the positions of the receiver section 203 and transmitter section 201, in which case the encoder strip 102 may be restrained by pressing against a surface of the receiver section 203 of the position detector. In either example, cleaning pad 105 may press against the opposite side of the encoder strip, such that the encoder strip slightly compresses the cleaning pad 105 to keep it in contact with the encoder strip over the length of travel of the printhead 101. The second cleaning pad 106 if present may also press against the opposite side of the encoder strip 102 in similar fashion to the cleaning pad 105. In FIG. 2 the encoder strip 102 is shown to be straight in FIG. 2, but due to the pressure on one side of the encoder strip by the cleaning pads 105 & 106 and the pressure on the other side of the encoder strip by the transmitter 201, the encoder strip will experience a slight deflection where it passes the cleaning pads and the transmitter.

In an example, a liquid solvent may be provided in the cleaning pad which may improve cleaning and prevent moistened particulate material being spread by the clearing pad. In examples where the chosen liquid has a lubricating effect, the liquid solvent may reduce stimulation of resonance as the cleaning pad moves over the encoder strip. The ink used in inkjet printers is generally water soluble. In examples where the lubricant contains or attracts water it may assist in cleaning the encoder by dissolving the particulate contaminants. In the dissolved state the contaminants may be more readily transfused through the surface of the cleaning pad to underlying material. If the contaminants were to remain dry they may remain and accumulate on the surface of the cleaning pad. Therefore in an example the cleaning pad is infused with a liquid lubricant which is hygroscopic such that water is present to dissolve the contaminants. An example is glycerol which has three hydroxyl groups and is hygroscopic in nature.

Figure 3:
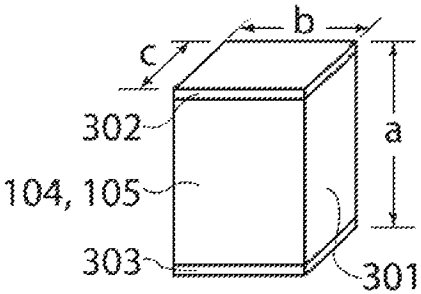
FIG. 3 diagrammatically illustrates an example of a cleaning pad of the type fitted to the printhead assembly of FIG. 2, in an uncompressed state.

Referring to FIG. 3, the cleaning pads 105, and/or 106 may each be, for example, a pad of unwoven fibrous material 301. The cleaning pads 105, 106 may have surface layers 302 & 303 but some examples may not. The cleaning pad may be compressible and may be compressed by in the range of 21-27% in the arrangement of FIG. 1. For example, in a cleaning pad as seen in FIG. 2, the thickness "a" (i.e. the width in the direction normal to the encoder strip 102 when in use) may be 6 mm (note that this dimension may be different for different printer designs), and as seen in FIG. 3, the compressed width "d" may be 4.38-4.72 mm. In this example the other dimensions are length "b" 10 mm and depth "c" 8 mm, giving an uncompressed volume of 0.48 $cm^3$ and a compressed volume of approximately 0.35-0.38 $cm^3$. The pad material may also have a Volumetric Ink Retention (VIR) Specification (i.e. the measure of Ink that the material can absorb—measured with fresh inkjet ink) of at least 60% of the uncompressed volume of the pad material (i.e. at least 0.6 $cm^3$ of liquid per 1 $cm^3$ of pad material). The pad material may also have a minimum Vertical Capillary Head (VCH) Specification of at least 80 mm of vertical capillary draw in 2 hours (again using fresh inkjet ink). The pad material may be a cellulose (paper fibre) based material. The pad material may or may not also have a synthetic fibre added for strength.

Examples of a suitable pad material are materials having a cellulose (paper fibre) based core 301 (refer to FIG. 2). These materials may also include a synthetic fibre (comprising for example polyethylene, polypropylene, polyester or a blend of two or more of these) added for strength. These materials may also have a synthetic non-woven top surface layer 302 and bottom surface layer 303 each comprising, for example, a nonwoven material of polyethylene, polypropylene, polyester fibres or a blend of these. The top and bottom surface material has enhanced strength over the core material 301 to provide a stable bottom surface 303 for adhesive fixture and a stable top surface 302 in use. In the event that the top surface layer 302 causes a restricted transfusion of ink through to the underlying cellulose material, this may be addressed by providing the pad 105 and/or 106 with an adequate surface area whereby the transfusion characteristics of the material will be sufficient to absorb and transfuse the dissolved particulate contaminants.

An example pad material comprises a cellulose body 301 containing about 40% short cut staple (5 mm) synthetic fibre (polyethylene/polypropylene blend) to provide internal strength and a non-woven surface cover (non-woven material of polyester fibres) for better surface strength when using adhesive attachment. Variations of this material in thickness of from 1-18 mm may be used depending on the printer and application.

This example material will swell by a maximum about 5% when fully saturated and the VIR of the material is close to 80% with fresh inkjet ink. This degree of ink retention is due to physical absorption of ink into the cellulose fibre instead of just by a surface layer capillary draw of fibre as with materials such as polyester needlefelt material.

This example material has a minimum vertical capillary draw (i.e. Vertical Capillary Head (VCH) Specification) of at least 80 mm in 2 hours using fresh inkjet ink.

Cleaning Pad Example with Cellulose Surface Layers

Another example material, comprises a cellulose body 301 containing 20-40% short cut staple (5 mm) synthetic fibre (polyethylene, polypropylene blend) added to the body 301 for internal strength. The surface layers 302 & 303 of the material are a non-woven cellulose tissue facing in comparison to the non-woven synthetic surface layer of the previous example material.

This example material can be expected to swell by up to 15% with full ink saturation. However this material has a lower cost than the previous example material since it does not have the blend of synthetic fibre added to the core 301. Swelling is not anticipated at the level of infusion proposed.

This example material has a Volumetric Ink Retention (VIR) of close to 80% minimum when tested with fresh inkjet ink, and a Vertical Capillary Head (VCH) of at least 80 mm of vertical capillary draw in 2 hours, again using fresh inkjet ink.

Materials found suitable as pad material include those designated SP0506 and XCA sold by Process Innovation Technology (PIT).

Solvent/Lubricant

An example of a suitable solvent/lubricant will be a hygroscopic liquid having lubricant properties. Aqueous glycerol is an example of a liquid with the desired properties and may comprise 20-35% glycerol and 70-80% water v/v.

In an example, the combination of aqueous glycerol with an absorbent cleaning pad can clean the encoder strip and moderate any tendency for resonant vibration to occur. Glycerol consists of three hydroxyl groups and is hygroscopic in nature. Combining such a lubricant with a resilient fibrous cleaning pad can create a complementary system in which the combined material features, characteristics and merits facilitate a robust and effective cleaning system that will work to mitigate contamination build up on the encoder strip of a carriage positioning encoder system. In accelerated life testing, using a pad of the first example material above (with synthetic surface layers) having dimensions of 10 mm×8 mm×6 mm and 0.3 $cm^3$ of aqueous glycerol (27% glycerol and 73% water) to clean away aerosol particulate deposits, a 40,000 page life can be achieved while running the printer at a rate of 1500 pages/day.

Hence, in examples in which the application of the hygroscopic lubricant, such as aqueous glycerol which is well suited for dissolving aerosol particles of inkjet inks, is combined with a cellulose based pad material, such as each of the example materials described above or similar, a suitable cleaning functionality may be achieved. To achieve such an outcome the following exemplary parameters and ratios may be used:

The volume of lubricant applied to each cleaning pad may be in the range of 60-80% of the uncompressed pad volume and preferably approximately 63% of the uncompressed pad volume. For a cleaning pad with uncompressed dimensions of 10 mm×8 mm×6 mm (0.48 $cm^3$) the volume of lubricant applied to each cleaning pad may be in the range of 0.29-0.38 $cm^3$ for example 0.3 $cm^3$.

Cleaning pads may vary in size depending upon printer size with larger printers having longer encoder strips and possibly having a larger cleaning pad volume to absorb aerosol over the life of the printer. For an A4 printer, one or cleaning pads may be provided, each with an uncompressed volume in the range of 0.4-0.6 $cm^3$. In the example discussed above two cleaning pads are used, each having dimensions of 6 mm×8 mm×10 mm giving an individual uncompressed volume of 0.48 cm3 or 0.96 $cm^3$ for two pads. Examples of cleaning pads for larger printers may have pad volumes which are increased by up to several cubic centimetres (e.g. 0.8-1.2 $cm^3$ for an A2 Printer or 1.6-2.4 $cm^3$ for an A0 printer).

The minimum VIR for effective cleaning may be 60% of the uncompressed volume of the cleaning pad. In the example given above the material has a VIR of greater than 80% and the actual volume of aqueous glycerol used is 0.3 $cm^3$in 0.48 $cm^3$ of pad material which equals 62.5% v/v. The aqueous glycerol may for example comprise glycerol in the range of 20-35% v/v with water. In the example described above the 27% glycerol v/v with water is used.

For an A4 printer, the area of the encoder strip to be cleaned may generally be about 363 mm×5 mm. For a 5 mm wide encoder strip, the cleaning pads, for example, may have a contact length of 7-10 mm giving a contact area range per cleaning pad of 35-50 $mm^2$. In the example above, the cleaning pads each have a contact surface area of 5 mm×8 mm=40 $mm^2$ giving a total area of contact for 2 cleaning pads of 80 $mm^2$. However the dimension of the encoder strip may vary depending on the size of the printer and again, for larger printers, examples of pad contact areas per cleaning pad might increase up to several hundred square millimetres (E.g. 70-100 $mm^2$ or more for an A2 Printer or 140-210 $mm^2$ or more for an A0 printer).

It will be appreciated that numerous variations and/or modifications may be made to the above-described examples, without departing from the broad general scope of the present disclosure. The present examples are, therefore, to be considered in all respects as illustrative and not restrictive.

What is claimed is:

1. A cleaning pad for wiping an encoder strip in a printer, the cleaning pad comprising a body of absorbent material and a hygroscopic lubricating liquid, wherein the hygroscopic lubricating liquid is infused into the pad at a volume of 0.6-0.8 $cm^3$ per 1 $cm^3$ of uncompressed pad volume.

2. The cleaning pad of claim 1 wherein the body of absorbent material comprises cellulose fibres.

3. The cleaning pad of claim 2 wherein the body of absorbent material includes synthetic fibres.

4. The cleaning pad of claim 1 further comprising a surface layer of non-woven fibrous material.

5. The cleaning pad of claim 4 wherein the surface layer is a layer of non-woven synthetic fibrous material.

6. The cleaning pad claim 1 wherein the hygroscopic lubricating liquid comprises aqueous glycerol.

7. A printer comprising a carriage, a position sensor to determine a position of the carriage, an elongate encoder strip extending past the carriage, wherein the carriage is movable in a path along the encoder strip, a cleaning pad having a fibrous body infused with a solvent and extending from the carriage to contact a surface of the encoder strip, whereby, with one of a transmitter and a receiver of the position sensor positioned at one side of the encoder strip and the cleaning pad positioned at an opposite side of the encoder strip, the cleaning pad wipes the surface of the encoder strip as the carriage moves in the path along the encoder strip.

8. The printer of claim 7 wherein the fibrous body comprises cellulose fibres which absorb the solvent.

9. The printer as claimed in of claim 8 wherein the fibrous body includes synthetic fibres to stabilise the cleaning pad.

10. The printer as claimed in of claim 8, the cleaning pad comprising a surface layer of non-woven fibrous material.

11. The printer as claimed in of claim 7 wherein the solvent comprises a hygroscopic lubricant.

12. The printer as claimed in of claim 11 wherein the solvent comprises aqueous glycerol.

13. The printer of claim 11, the hygroscopic lubricant infused into the cleaning pad at a volume of 0.6-0.8 $cm^3$ per 1 $cm^3$ of uncompressed pad volume.

14. The printer of claim 7, the cleaning pad having a volumetric ink retention of at least 60% of uncompressed pad volume.

15. The printer of claim 7, the cleaning pad having a minimum vertical capillary head of at least 80 mm of vertical capillary draw in 2 hours.

16. A method comprising:

infusing a cleaning pad, having a fibrous body, with a hygroscopic lubricant, attaching the cleaning pad to a carriage, positioning one of a transmitter and a receiver of a position sensor for contact with one side of an encoder strip and positioning the cleaning pad for contact with an opposite side of the encoder strip, wherein the carriage is movable in a path along the encoder strip and the cleaning pad is in contact with the encoder strip to wipe a surface of the encoder strip as the carriage moves in the path along the encoder strip.

17. The method of claim 16 wherein the fibrous body comprises cellulose fibres and the hygroscopic lubricant comprises aqueous glycerol.

18. The method of claim 16 wherein the hygroscopic lubricant is infused into the cleaning pad at a volume of 0.6-0.8 $cm^3$ per 1 $cm^3$ of uncompressed pad volume.

19. The method of claim 16 wherein the cleaning pad has a volumetric ink retention of at least 60% of uncompressed pad volume and a minimum vertical capillary head of at least 80 mm of vertical capillary draw in 2 hours.

20. The method of claim 16 wherein the fibrous body includes a cellulose core with a top surface layer and a bottom surface layer each comprising a synthetic non-woven material.

* * * * *